US006479934B2

(12) United States Patent
Nishio

(10) Patent No.: US 6,479,934 B2
(45) **Date of Patent: *Nov. 12, 2002**

(54) AC-DRIVEN SURFACE DISCHARGE PLASMA DISPLAY PANEL HAVING TRANSPARENT ELECTRODES WITH MINUTE OPENINGS

(75) Inventor: Takashi Nishio, Yamanashi (JP)

(73) Assignee: Pioneer Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/441,887

(22) Filed: Nov. 17, 1999

(65) Prior Publication Data

US 2002/0140341 A1 Oct. 3, 2002

(30) Foreign Application Priority Data

Nov. 19, 1998 (JP) ..... 10-329339

(51) Int. Cl.[7] ..... H01J 17/49

(52) U.S. Cl. ..... 313/586; 313/582; 313/585; 313/587

(58) Field of Search ..... 313/586, 582, 313/583, 584, 585, 587

(56) References Cited

U.S. PATENT DOCUMENTS

| | | | | | |
|---|---|---|---|---|---|
| 5,742,122 | A | * | 4/1998 | Amemiya et al. | 313/582 |
| 5,962,974 | A | * | 10/1999 | Komaki et al. | 313/582 |
| 6,084,349 | A | * | 7/2000 | Ueoka et al. | 313/587 |
| 6,118,214 | A | * | 9/2000 | Marcotte | 313/582 |
| 6,172,461 | B1 | * | 1/2001 | Ha | 313/585 |
| 6,236,160 | B1 | * | 5/2001 | Komaki et al. | 313/586 |

FOREIGN PATENT DOCUMENTS

| | | | | |
|---|---|---|---|---|
| JP | 08315735 | * | 11/1996 | H01J/11/02 |

* cited by examiner

*Primary Examiner*—Nimeshkumar D. Patel
*Assistant Examiner*—Sikha Roy
(74) *Attorney, Agent, or Firm*—Morgan, Lewis & Bockius LLP

(57) ABSTRACT

An AC-driven surface discharge plasma display panel (AC-PDP) includes a pair of substrates that face each other and define a discharge space therebetween, a pair of electrodes for each display line formed on an inner surface of one of the two substrates such that the electrodes face each other and define a discharge gap therebetween, each of the electrodes having minute openings, and a dielectric layer covering the electrodes. The panel has enhanced emission efficiency properties that do not suffer from deterioration.

15 Claims, 3 Drawing Sheets

AC-DRIVEN SURFACE DISCHARGE PLASMA DISPLAY PANEL HAVING TRANSPARENT ELECTRODES WITH MINUTE OPENINGS

This application claims the benefit of Japanese patent application No. 10-329339, filed Nov. 19, 1998, which is hereby incorporated by reference.

BACKGROUND OF THE INVENTION

1. Field of the Invention

The present invention relates to an AC-driven surface discharge plasma display panel (AC-PDP), and more particularly, to an AC-PDP having a lower discharge start voltage.

2. Description of the Related Art

A plasma display panel (PDP) typically has a large size and thin color display. FIG. 1 is a cross-sectional view of an AC-driven surface discharge plasma display panel (AC-PDP). The structure and operation of this AC-PDP will be described next.

As shown in FIG. 1, the AC-PDP includes a glass substrate 1 located on the front side, and has a pair of discharge-sustaining electrodes 2, 2 for each display line. These electrodes maintain the electric discharge and are formed by a film having a thickness of several hundred nanometers. A dielectric layer 3 covers the electrodes 2 and is made of a film having a thickness of 20 to 30 $\mu$m. A protective layer 4, which is made of MgO, covers the dielectric layer 3.

Each electrode 2 includes a plurality of transparent electrodes 2*a*, which are made of a wide transparent conductive film, and narrow metal auxiliary electrodes 2*b* to complement the conductivity of the transparent electrodes 2*a*. As a result, the metal auxiliary electrodes 2*b* are required to have a low resistance and are made of a metal film, such as aluminum or the like.

Specifically, the dielectric layer 3 is formed by first applying a low-melting point glass paste, which includes lead oxide (PbO), to the electrodes 2 and then, baking the paste.

Another glass substrate 5 is located on the rear side of the AC-PDP, as shown in FIG. 1. A plurality of electrodes 6 are formed as addressing electrodes and extend parallel to each other. Ribs, which are not shown in FIG. 1, are also formed between the successive electrodes 6. A phosphor layer 7 is formed such that it covers the top surfaces of the electrodes 6 and the side surfaces of the ribs.

In this AC-PDP, the glass substrates 1 and 5 are spaced from each other such that the electrodes 2 on the glass substrate 1 face and extend perpendicularly with respect to the electrodes 6 on the glass substrate 5. As a result, a discharge space 8 is formed between the glass substrates when the outer periphery is sealed.

The ribs formed between the electrodes 6 partition the discharge space 8 into discharge cells along the direction in which the discharge-sustaining electrodes 2 extend. That is, the ribs partition the discharge space 8 into discharge cells in the direction of the display lines. The ribs also determine the gaps between the cells in the discharge space 8. After sealing the glass substrates 1 and 5, the discharge space 8 is evacuated, and then, rare gases are sealed in the space.

In this way, the AC-PDP of FIG. 1 has plural discharge cells. Furthermore, pixel cells are formed around the intersections of the electrodes 2 on the glass substrate 1 and the electrodes 6 on the glass substrate 5. Thus, an image can be displayed using this AC-PDP.

An operation that causes the discharge cells of this AC-PDP to emit light will be explained now. First, a discharge start voltage, which is a given voltage, is applied between the pair of discharge-sustaining electrodes 2 to produce electric discharge. As a result, wall charge is created. Then, a selection-eliminating pulse is applied to the addressing electrodes 6 corresponding to discharge cells that are not necessary for the display. In this manner, the wall charge on the dielectric layer 3 is eliminated.

Next, a sustaining pulse is applied to the electrode pair 2, 2. As a result, the electric discharge is maintained in the discharge cells whose wall charge was not removed. This sustained electric discharge emits ultraviolet radiation, which excites the phosphor layer 7, and as a result, light is emitted. In this AC-PDP, the protective layer 4 enhances the efficiency of the second electron emission and lowers the discharge start voltage.

The phosphor layer 7 provides a high-brightness display in an AC-PDP, such as the one described above. Moreover, the phosphor layer does not deteriorate and has a long life because it does not directly undergo an ion impact during discharge.

In an AC-PDP, such as the one described above, the discharge start voltage can be lowered by reducing the thickness of the dielectric layer 3. However, reducing the thickness causes an increase in the current density, which decreases the emission efficiency of the AC-PDP, shortens the life of the protective layer 4, and increases line or electrode breaks.

The amount of discharge current flowing through each discharge cell can be reduced by partially narrowing the transparent electrodes 2*a* that are opposite to each other within each discharge cell. However, this does not decrease the current density.

SUMMARY OF THE INVENTION

Accordingly, the present invention is directed to an AC-driven surface discharge plasma display panel (AC-PDP) that substantially obviates one or more of the problems due to limitations and disadvantages of the related art.

An object of the present invention is to provide an AC-PDP having a lower discharge start voltage and a thinner dielectric layer, as compared to the AC-PDP of FIG. 1, by preventing an increase in the current density and without decreasing the emission efficiency, shortening the life of the protective layer 4, or increasing line or electrode breaks. That is, the AC-PDP may alleviate a decrease in the emission efficiency by preventing increases in the current density.

Additional features and advantages of the invention will be set forth in the description which follows, and will be apparent from the description, or may be learned by practice of the invention. The objects and other advantages of the invention will be realized and attained by the structure particularly pointed out in the written description and claims hereof as well as the appended drawings.

In a first aspect and to achieve these and other advantages in accordance with the purpose of the invention, as embodied and broadly described herein, an AC-driven surface discharge plasma display panel (AC-PDP) includes a pair of substrates that face each other and define a discharge space therebetween, a pair of electrodes for each display line formed on an inner surface of one of the two substrates such that the electrodes face each other and define a discharge gap therebetween, wherein each of the electrodes has minute openings, and a dielectric layer covering the electrodes.

In another aspect, the present invention provides an AC-PDP having, in addition to the features of the AC-PDP of the first aspect, electrodes with minute openings such that the minute openings preferably have diameters smaller than the thickness of the dielectric film.

In a third aspect, the present invention provides an AC-PDP including, in addition to the features of the AC-PDP of the first aspect, electrodes that include transparent electrodes and metal electrodes. The metal electrodes are formed on the transparent electrodes and are spaced from the discharge gap. The minute openings are formed on the transparent electrodes.

In a fourth aspect, the present invention provides an AC-PDP including, in addition to the features of the AC-PDP of the third aspect, transparent electrodes that have protrusions located on opposite sides of the discharge gap in each discharge cell.

In a fifth aspect, the present invention provides an AC-driven surface discharge plasma display panel including first and second substrates that face each other and define a discharge space therebetween, discharge-sustaining electrodes formed on the first substrate, wherein the discharge-sustaining electrodes have minute openings, a first dielectric layer covering the discharge-sustaining electrodes, and addressing electrodes and ribs formed on the second substrate.

In the AC-PDP of the present invention, each of the transparent electrodes in a pair are located on opposite sides of a discharge gap for each display line. Since these transparent electrodes have plural minute openings, the area of transparent electrode in each discharge cell is smaller than the area of a transparent electrode without such openings. Therefore, the amount of discharge current per discharge cell, which is produced by the operating voltage applied to the electrodes, decreases.

Furthermore, by setting the diameter of the minute openings in the electrodes to be smaller than the thickness of the dielectric layer, the average density of the electric force lines on the surface of the dielectric layer can be decreased. The current density in the discharge space can be also reduced. Consequently, if the dielectric layer of the AC-PDP is made thinner and the operating voltage is lowered, the current density does not increase. Accordingly, the decrease in the emission efficiency of the AC-PDP can be circumvented. Additionally, the decrease in the life of the protective layer and line or electrode breaks can also be suppressed.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 2:
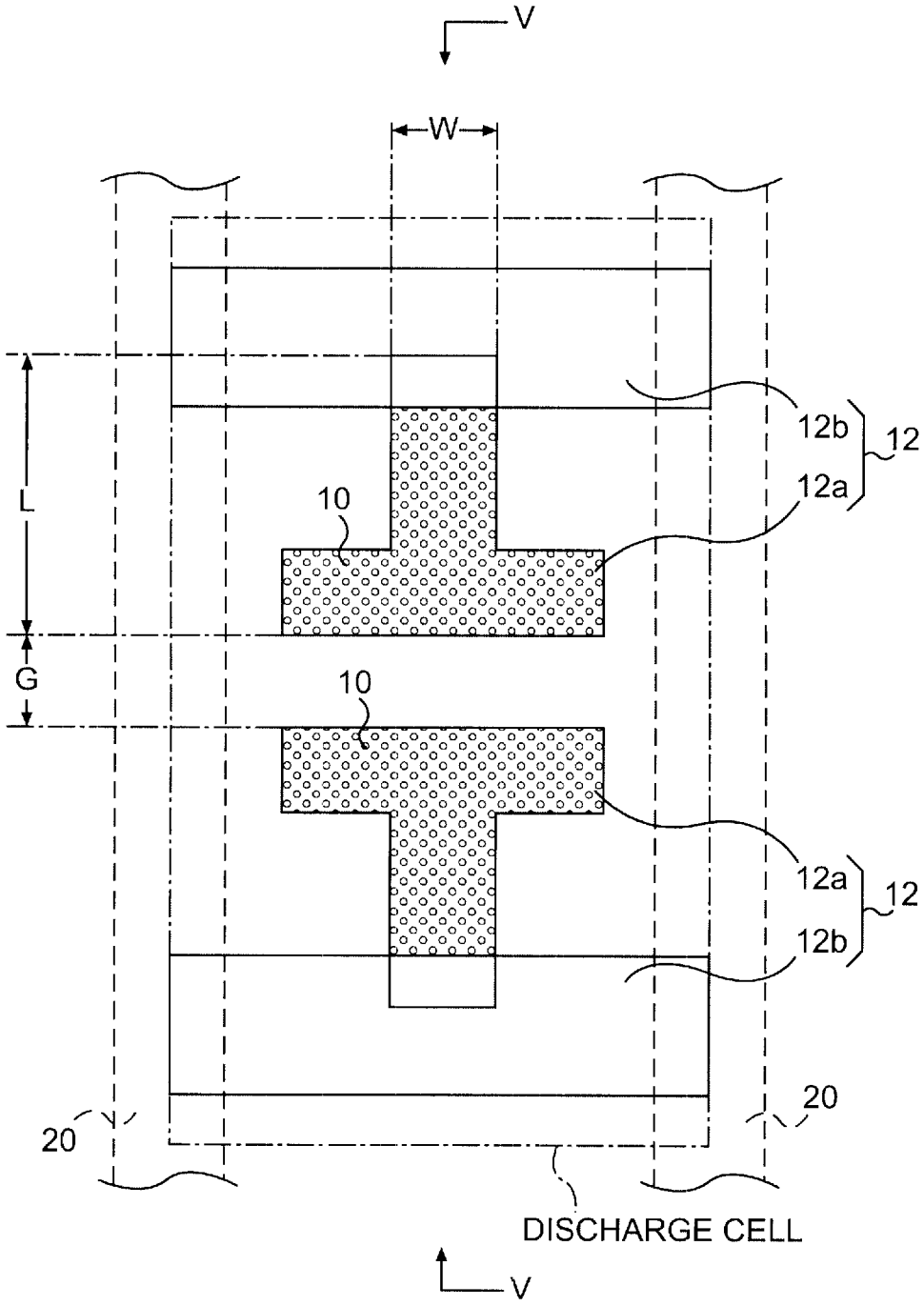
FIG. 2 is a plan view of an AC-PDP in accordance with an embodiment of the present invention.

A preferred embodiment of the present invention will be explained now by referring to FIGS. 2 and 3. FIG. 2 is a plan view of an AC-driven plasma display panel (AC-PDP) in accordance with an embodiment of the present invention and FIG. 3 is a cross-sectional view of this AC-PDP taken along line V—V of FIG. 2.

Figure 3:
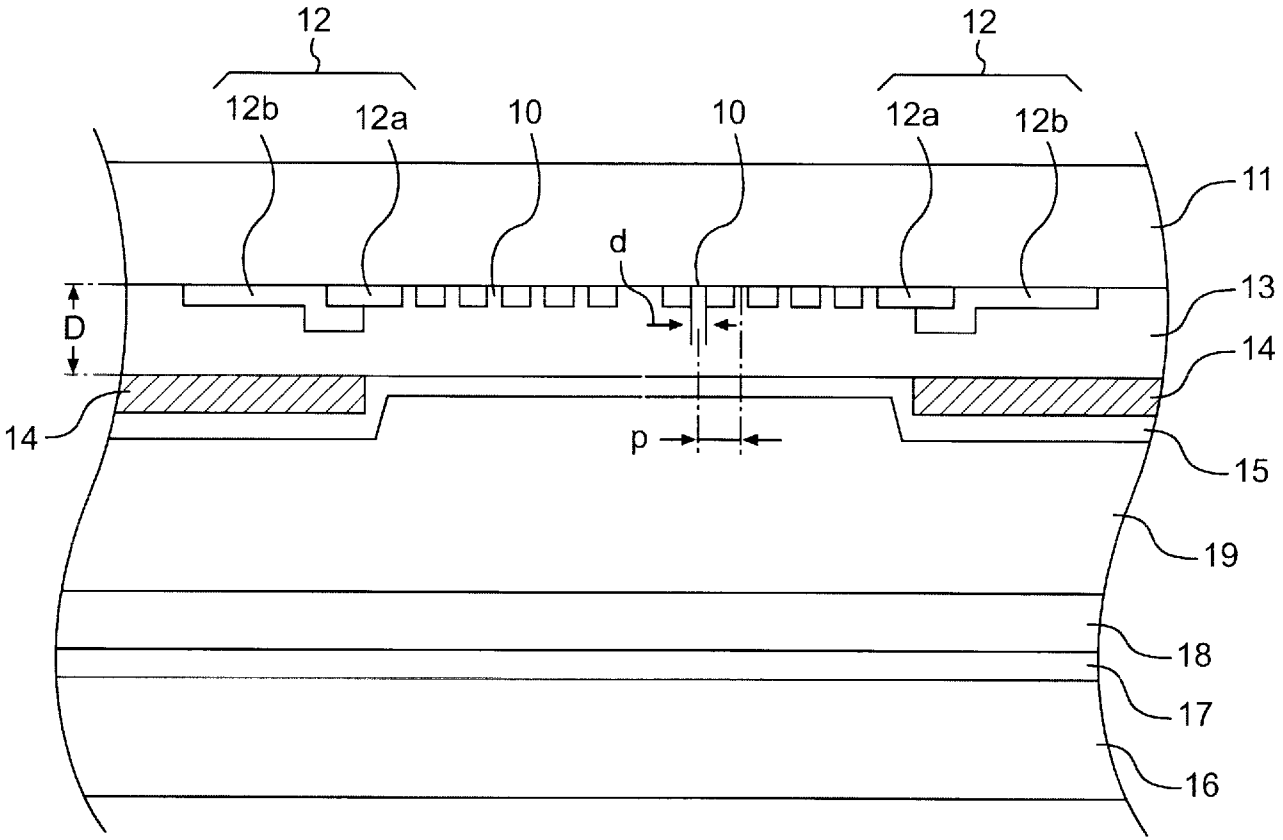
FIG. 3 is a cross-sectional view of the AC-PDP of FIG. 2 taken along line V—V of FIG. 2.

As shown in FIG. 3, a glass substrate 11 is placed on the front side of the AC-PDP and discharge-sustaining electrodes 12 are formed on the glass substrate 11. A pair of electrodes 12 sustain an electric discharge and are positioned on opposite sides of a discharge gap G, as shown in FIG. 2, for each display line. The electrodes 12 extend horizontally. That is, the electrodes 12 extend along the display lines.

The structure of the electrode 12 for sustaining the electric discharge will be described in detail now. Each electrode 12 includes transparent electrodes 12*a* and metal auxiliary electrodes 12*b*, the latter of which is made of a horizontally extending body in a belt shape. The transparent electrodes 12*a* are formed independently of each other and have an island-like form in each discharge cell. Moreover, a pair of transparent electrodes 12*a* have a discharge gap G disposed between them, as shown in FIG. 2.

Specifically, each transparent electrode 12*a* comprises a wide portion that is close to the electric discharge gap G and a narrow portion that is continuous with the wide portion. In the present embodiment, the transparent electrode 12*a* has an independent T-shaped form in each discharge cell emitting light, as shown in FIG. 2. The side facing away from the discharge gap G has a narrow end that is electrically connected with the metal auxiliary electrode 12*b*, as shown in FIG. 2.

Furthermore, each transparent electrode 12*a* is also provided with plural minute openings that are spaced from each other regularly or irregularly. For example, in the present embodiment, the minute openings are circular, as shown in FIG. 2.

A dielectric layer 13, as shown in FIG. 3, coats the electrodes 12 and is thinner than the dielectric layer of a conventional PDP. In addition, a thick dielectric layer 14 is formed on only the portion of the dielectric layer 13 that covers the metal auxiliary electrode 12*b*.

A protective layer 15 that consists of MgO is formed such that it covers the dielectric layer 13 and the thick dielectric layer 14.

Another glass substrate 16 is located on the rear side of the AC-PDP. The two glass substrates are located on opposite sides of an electric discharge space 19. Plural addressing electrodes 17 are formed on the rear glass substrate 16 such that the electrodes 17 are perpendicular to the discharge-sustaining electrodes 12. A rib 20 is formed between any two adjacently placed addressing electrodes 17. A phosphor layer 18 covers the top surface of each addressing electrode 17 and the side surface of each rib 20.

The ribs 20 partition the discharge space 19 in the direction of the display lines to form discharge cells. Accordingly, the ribs 20 determine the dimensions of the gap in the discharge space 8. As a result, the AC-PDP has plural discharge cells, which are formed around the intersections of the electrode pair 12 on the glass substrate 11 and the addressing electrodes 17 on the glass substrate 16. The operation of this AC-PDP will be explained next.

Figure 1:
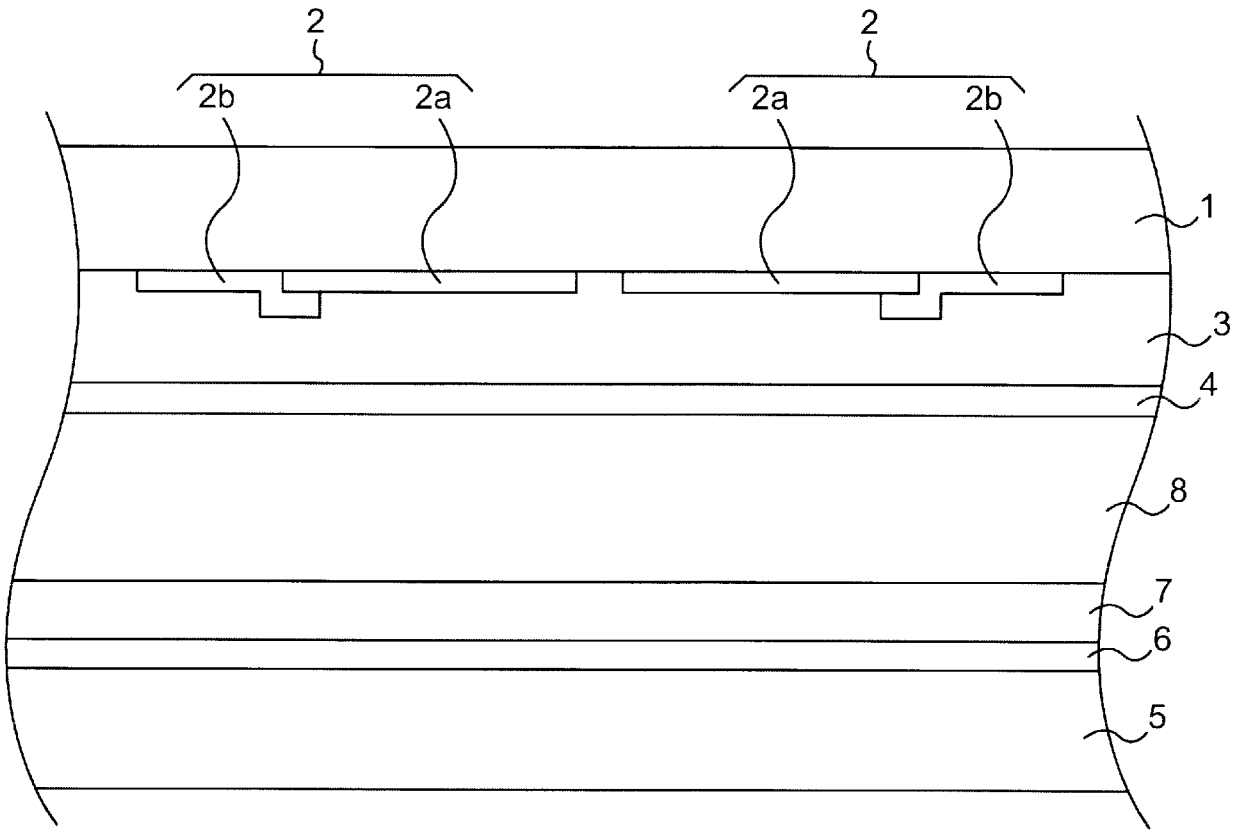
FIG. 1 PRIOR ART
FIG. 1 is a cross-sectional view of the structure of an AC-driven surface discharge plasma display panel (AC-PDP)

When the discharge cells of the AC-PDP are activated to emit light, a discharge start voltage, which is a given voltage, is applied across the pair of electrodes 12 to initiate an electric discharge. However, unlike the AC-PDP of FIG. 1, this activation is enabled with a lower discharge start voltage because in the present invention, the thickness D of the dielectric layer 13 is less than the thickness of the dielectric layer of the AC-PDP of FIG. 1.

Moreover, although the thickness of the dielectric layer is reduced, an increase in the current density is prevented in the present invention. The minute openings 10 in the transparent electrode 12*a* reduce the total area of the transparent conductive film, whereas the AC-PDP of FIG. 1 had no such openings. Moreover, the T-shaped contour of the transparent electrodes 12*a*, which emits electric force lines, is also maintained, as shown in FIG. 2. Therefore, the amount of discharge current flowing through each discharge cell, and the density of the electric force lines on the surface of the dielectric layer 13, decrease. Furthermore, the current density in the discharge space also drops.

As mentioned above, it is an object to maintain the T-shaped contour and reduce the total area of the transparent electrodes 12*a*. First, to maintain the T-shaped contour of the transparent electrode 12*a*, the diameter d of the minute openings 10 is required to be set sufficiently smaller than the width W and length L of the transparent electrode 12*a*, as shown in FIG. 3. Furthermore, the openings 10 must be dispersed within the T-shaped region.

Second, to reduce the total area of the transparent electrodes 12*a*, the diameter d of the minute openings 10 must be set to some value. However, if the diameter d of the openings is set such that it is much larger than the thickness of the dielectric layer 13, electric charge sufficient to start electric discharge cannot be secured near the surface of the dielectric layer 13.

Accordingly, in the present embodiment, the diameter d of the minute openings 10 is set smaller than the thickness D of the dielectric layer 13, as shown in FIG. 3. Preferably, the diameter d should be less than half of the thickness D of the dielectric layer 13. Furthermore, the diameter d should be sufficiently smaller, than the width W and length L of the transparent electrode 12*a*, as shown in FIG. 2. For example, the diameter d can be approximately 10 to 20 $\mu$m or less.

Moreover, the pitch p of the minute openings 10 is set such that it is about 2 to 4 times as large as the diameter d of the openings.

As a result, the discharge start voltage and the amount of discharge current at the beginning of discharge are reduced, as compared with a prior art AC-PDP. The current density also decreases. Therefore, even if the thickness of the dielectric layer 13 is reduced, the decrease in the emission efficiency of the AC-PDP and in the life of the protective layer 15 is suppressed.

The preferred embodiment described is not limited to the foregoing description. For example, in the embodiment described above, the minute openings 10 are circular. However, the shape of the minute openings 10 is not limited to this. The shape can be square, rectangular, or polygonal. In addition, the minute openings 10 may be nonuniform in dimension and/or shape.

Moreover, in the embodiment described above, the transparent electrodes 12*a* are independent and assume a T-shaped form in each discharge cell. However, the arrangement is not limited to this. Each transparent electrode 12*a* may have a belt-like body extending in the direction of the display lines and may have protrusions located on opposite sides of a discharge gap in each discharge cell. Alternatively, the transparent electrodes may also extend like belts in the direction of the display lines.

In the present invention, two transparent electrodes are located on opposite sides of a discharge gap for each display line. Since each transparent electrode has plural minute openings, the area of transparent electrode in each discharge cell is smaller than the area of a transparent electrode without such openings. Therefore, the amount of discharge current per discharge cell, which is produced by the operating voltage applied to the electrodes, decreases. Furthermore, the current density within the discharge space decreases because the diameter of the minute openings in the electrodes is smaller than the thickness of the dielectric layer. Consequently, if the dielectric layer of the AC-PDP is made thinner and the operating voltage is lowered, the current density does not increase. Accordingly, the decrease in the emission efficiency of the AC-PDP can be circumvented. Additionally, the decrease in the life of the protective layer and line or electrode breaks can also be suppressed.

While the invention has been described in detail and with reference to specific embodiments thereof, it will be apparent to one skilled in the art that various changes and modifications can be made therein without departing from the spirit or scope thereof. Thus, it is intended that the present invention covers the modifications and variations of this invention provided they come within the scope of the appended claims and their equivalents.

What is claimed is:

1. An AC-driven surface discharge plasma display panel, comprising:

a pair of substrates that face each other and define a discharge space therebetween;

a pair of electrodes for each display line formed on an inner surface of one of the two substrates such that the electrodes face each other and define a discharge gap therebetween;

a dielectric layer covering the electrodes; and ribs formed on an inner surface of the other of the two substrates so as to partition the discharge space in a direction of the display lines to form discharge cells, wherein each of the electrodes has projection portions facing each other through the discharge gap in each discharge cell, and wherein each of the projection portions of the electrodes has a plurality of minute openings and the minute openings are formed on a region substantially adjacent to the discharge gap.

2. The AC-driven surface discharge plasma display panel as recited in claim 1, wherein the minute openings have a diameter smaller than a thickness of the dielectric layer.

3. The AC-driven surface discharge plasma display panel as recited in claim 2, wherein a pitch of the minute openings is larger than the diameter of the minute openings.

4. The AC-driven surface discharge plasma display panel as recited in claim 1, wherein the pair of electrodes include transparent electrodes and metal electrodes that are formed on the transparent electrodes and spaced from the discharge gap, wherein the minute openings are formed on the transparent electrodes.

5. The AC-driven surface discharge plasma display panel as recited in claim 4, wherein the transparent electrodes are formed independent of each other and have an island-like form in each discharge cell.

6. An AC-driven surface discharge plasma display panel, comprising:

first and second substrates that face each other and define a discharge space therebetween;

discharge-sustaining electrodes formed on the first substrate;

a first dielectric layer covering the discharge-sustaining electrodes;

addressing electrodes and ribs formed on the second substrate, said addressing electrodes being arranged in a direction orthogonal to said discharge-sustaining electrodes to form intersections of said pair of discharge-sustaining electrodes; and discharge cells formed in the discharge space corresponding to each intersection of said discharge-sustaining electrodes and addressing electrodes, wherein each of the discharge sustaining electrodes has projection portions facing each other through a discharge gap in each discharge cell, and wherein each of the projection portions of the discharge-sustaining electrodes has a plurality of minute openings and the minute openings are formed on a region substantially adjacent to the discharge gap.

7. The AC-driven surface discharge plasma display panel as recited in claim 6, wherein the minute openings have a diameter smaller than a thickness of the dielectric layer.

8. The AC-driven surface discharge plasma display panel as recited in claim 7, wherein a pitch of the minute openings is larger than the diameter of the minute openings.

9. The AC-driven surface discharge plasma display panel as recited in claim 8, wherein the discharge-sustaining electrodes include transparent electrodes and metal electrodes that are formed on the transparent electrodes.

10. The AC-driven surface discharge plasma display panel according to claim 9, wherein the minute openings are formed on the transparent electrodes of the discharge-sustaining electrodes.

11. The AC-driven surface discharge plasma display panel as recited in claim 10, further comprising:

a second dielectric layer formed on a portion of the first dielectric layer;

a protective layer covering portions of the first and second dielectric layers; and a phosphor layer covering portions of the ribs and the addressing electrodes.

12. The AC-driven surface discharge plasma display panel as recited in claim 11, wherein the transparent electrodes are formed independent of each other and have substantially similar forms in each discharge cell.

13. The AC-driven surface discharge plasma display panel as recited in claim 12, wherein a pair of the discharge-sustaining electrodes are required for each display line and are formed on the first substrate such that the discharge-sustaining electrodes face each other and define a discharge gap therebetween.

14. The AC-driven surface discharge plasma display panel as recited in claim 13, wherein the transparent electrodes include a wide portion and a narrow portion such that the transparent electrodes have a T-shaped form in each discharge cell.

15. The AC-driven surface discharge plasma display panel as recited in claim 13, wherein the transparent electrodes have a belt-like body extending in the direction of the display lines and have protrusions located on opposite sides of the discharge gap in each discharge cell.

* * * * *